US006912938B2

(12) United States Patent
Kurtz

(10) Patent No.: US 6,912,938 B2
(45) Date of Patent: Jul. 5, 2005

(54) VEHICLE PEDAL DEPRESSOR

(75) Inventor: Scotty R. Kurtz, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 137 days.

(21) Appl. No.: 10/223,825

(22) Filed: Aug. 20, 2002

(65) Prior Publication Data

US 2004/0035264 A1 Feb. 26, 2004

(51) Int. Cl.[7] ..... B25B 33/00
(52) U.S. Cl. ..... 81/488; 254/DIG. 5; 81/177.2
(58) Field of Search ..... 81/177.6, 488, 81/489; 269/166, 167; 254/DIG. 5, 133 A, 100, 133 R, 134

(56) References Cited

U.S. PATENT DOCUMENTS

| | | | | | |
|---|---|---|---|---|---|
| 1,681,192 | A | * | 8/1928 | McBride | 254/DIG. 5 |
| 2,866,356 | A | * | 12/1958 | Elam | 254/DIG. 5 |
| 4,957,257 | A | * | 9/1990 | Gonzalez | 269/167 |
| 5,238,213 | A | | 8/1993 | Pool | |
| 5,427,355 | A | * | 6/1995 | Sukonthapanich | 254/100 |
| 5,427,364 | A | * | 6/1995 | Zborschil | 269/166 |
| 5,583,288 | A | | 12/1996 | Brenner et al. | |
| 6,079,703 | A | * | 6/2000 | Chavez, Jr. | 269/166 |
| 6,202,519 | B1 | * | 3/2001 | Yandt | 81/488 |
| 6,279,418 | B1 | * | 8/2001 | Olive, Jr. | 254/DIG. 5 |
| 2001/0045124 | A1 | | 11/2001 | Mouck et al. | |

OTHER PUBLICATIONS

Pedal Pusher, Segle Products, Inc., Ontario, Canada.
Pedal Pusher, No. J 39610, Kent–Moore.
Invention Disclosure Agreement with Richard Ferraro, Air Operated Cylinder.
Invention Disclosure Agreement with Charles J. Pastor, Truck Clutch Adjustment Tool.
Invention Disclosure Agreement with Roy July Flores, Clutch Adjustment tool.
Invention disclosure Agreement with Israel Garza. Clutch Adjusting tool.
Invention Disclosure Agreement with Robert Koivisto, Heavy Duty Clutch Adjustment and Cam Brake Adjustment Tool.
Invention Disclosure Agreement with Steven Bauer for Clutch Adjustment and Clutch Brake Installation Tool.
Universal Throttle Pedal Depressor, No. 393, Thexton Catalog.
Steering Wheel Holder, No. WA96A and Brake and Accelerator Pedal Jack, No. B240A, Snap–On Catalog, p. E70.
Pedal Press, No. PP29 and Universal Throttle Depressor, No. 393, Matco Tools Catalog.
Invention Disclosure Agreement with Robert Love, Warmer Upper.
Invention Disclosure Agreement with Talley Neely, III, Brake and Accelerator Pedal Jack.
Invention Disclosure Agreement with C. R. Wooster, Brake and Accelerator Pedal Hold Down tool.
Invention Disclosure Agreement with Jeff Milliff, Telescoping Mechanic's Crutch.
Invention Disclosure Agreement with Joe Brown, Device to Run Engines at Fast Idle.
Invention Disclosure Agreement with Edward Brummitt, Telescoping rod that Pushes on a Gas Pedal.
Invention Disclosure Agreement with Todd S. Peters, Tool for Depressing the Foot Feed Clutch or Brake Pedals.

(Continued)

*Primary Examiner*—James G. Smith
(74) *Attorney, Agent, or Firm*—Banner & Witcoff, Ltd.

(57) ABSTRACT

A pedal depressor for a truck or large vehicle includes adjustable telescoping tubes with a locking plate for locking the tubes in a fixed position. A rubber tip is provided at one end for engaging a pedal and a Y-shaped yoke, which is rotatably adjustable, is provided at the other end of the tool.

14 Claims, 2 Drawing Sheets

OTHER PUBLICATIONS

Invention Disclosure Agreement with Joe Mitchell, Accelerator Pedal.
Invention Disclosure Agreement with Juan Caballero, Telescoping Tool to Depress Throttle Pedal.
Invention Disclosure Agreement with John Schaffner, (The Assistant) Throttle Controlling Device.
Invention Disclosure Agreement with Arnold Dugat, Adjustable Throttle Jack Tool.

* cited by examiner

VEHICLE PEDAL DEPRESSOR

BACKGROUND OF THE INVENTION

In a principal aspect, the present invention relates to an adjustable pedal depressor for use, in particular, with large vehicles to facilitate service and repair of such vehicles by engaging and maintaining a pedal, such as a brake pedal, in a depressed, fixed position.

When servicing vehicles, particularly trucks, buses and heavy vehicles, it is often necessary to check systems, such as the braking system or the clutch mechanism. When engaged in such efforts, it is often desirable to depress the brake pedal, the clutch pedal, or other pedals within the vehicle and to maintain the pedals in a depressed position while attending to service with respect to that particular system. Proposals have been made to use a pedal depressor which will engage a portion of the vehicle, for example, the seat, and provide a brace between the seat and the brake pedal or the like. Various devices have been proposed for accomplishing such an objective, including devices such as illustrated in the following disclosure: Application of Glen Mouck, Ser. No. 09/801,791, filed Mar. 9, 2001.

While such a mechanism has proven to be useful, there has remained the need to provide for an easily adjustable mechanism which may be engaged with not only a steering wheel, but also with a seat or other contact point in order to maintain a pedal in a depressed position. Such a device should be easily adjustable, compact and simple to use, yet adequately rugged for the heavy duty usage associated with vehicles such as trucks.

BRIEF DESCRIPTION OF THE INVENTION

Briefly, the present invention comprises a telescoping tube that receives a second tube. The telescoping tube includes a projecting tip at one end and fits, slidably over the second tube at its opposite end. The second tube may be braced against the steering wheel or seat of the vehicle. An adjustable locking plate mounted on the telescoping tube engages and maintains the telescoped tube in a fixed adjusted position relative to the second tube. The tip of the telescoped tube includes an elastomeric non-slip material, socket member which may engage against the pedal. The opposite end of the second tube includes a yoke which is a Y-shaped member having opposite arms that fit around a steering wheel handle, for example, and further includes a center projection that is rotatable in the second tube to accommodate the angular relationship between the steering wheel and the pedal which is being depressed.

Thus, it is an object of the invention to provide an improved, adjustable pedal depressor for vehicles, particularly useful for maintaining a brake pedal of a large sized vehicle in a depressed position during servicing and repair work.

It is a further object of the invention to provide an adjustable length pedal depressor having opposite ends especially designed to maintain engagement with a pedal at one end and a steering wheel or seat at the opposite end.

Yet another object of the invention is to provide an adjustable pedal depressor which can be easily adjusted to maintain a fixed and desired length with a minimum of manual adjustment.

A further object of the invention is to provide an adjustable pedal depressor which is economical, rugged, easy to use, and sized so as not to interfere with a maintenance or servicing operation.

A further object of the invention is to provide an adjustable pedal depressor which may be easily disassembled for storage or packaging and easily reassembled.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
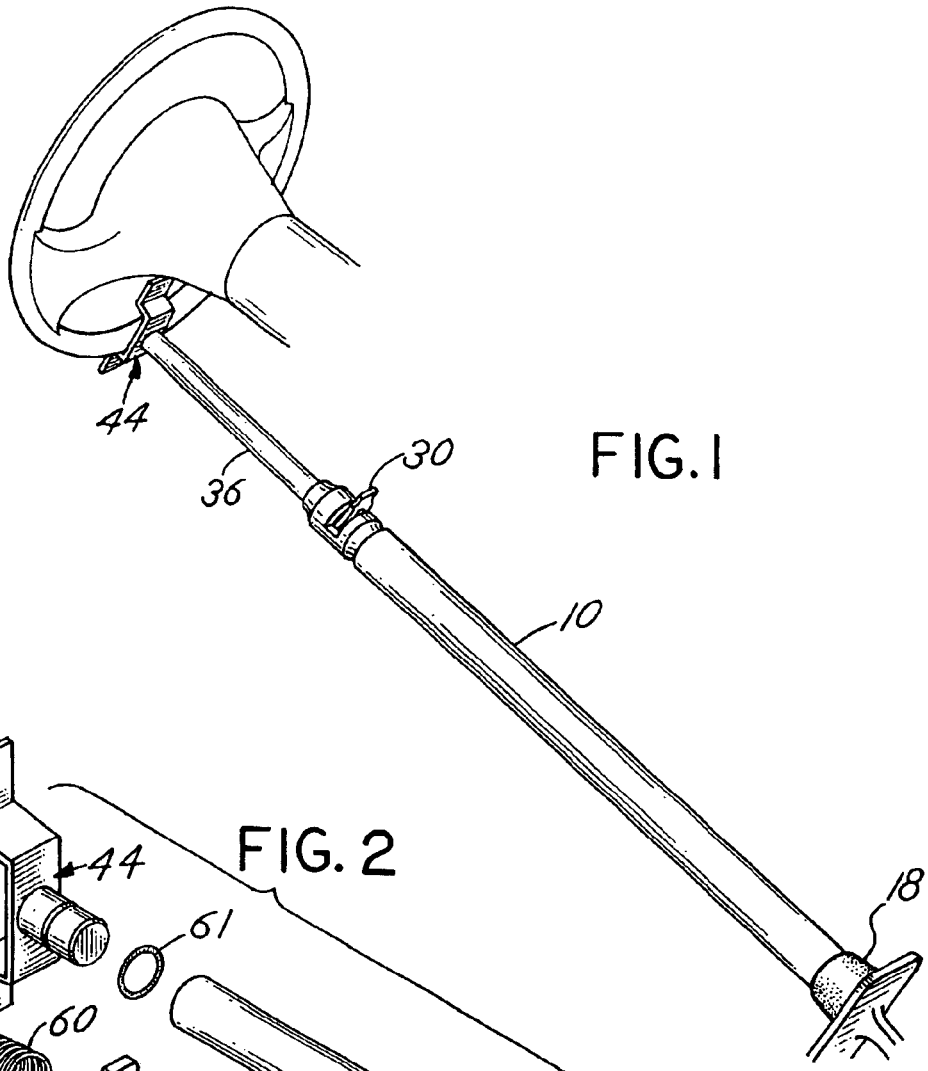
FIG. 1 is an isometric view depicting the adjustable pedal depressor of the invention in position engaging a pedal at one end and against a steering wheel of a vehicle at the opposite end.
Figure 2:
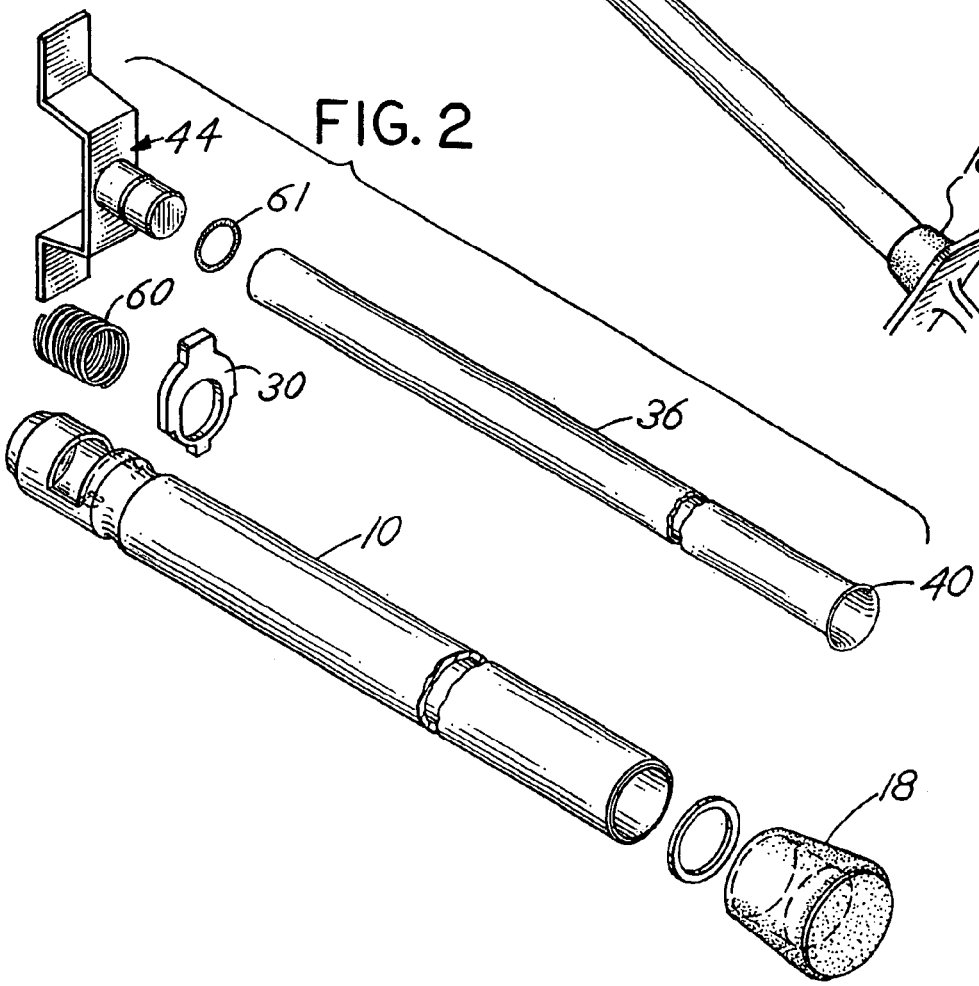
FIG. 2 is an exploded isometric view of the pedal depressor depicted in FIG. 1.

Referring to the figures, the pedal depressor of the invention is comprised of a first hollow elongate tube or handle 10 which, in the embodiment depicted, is a cylindrical tubular member having a pedal engaging end 12 and an opposite open end 14. The first hollow elongate tube 10 includes a cylindrical bore passage or opening 16 extending from the open end 14 through the pedal engaging end 12. An elastomeric tip or socket 18 comprised of a non-skid material is fitted over the pedal engaging end 12. Thus, the tip or socket 18 includes a counterbore 20 into which the pedal engaging end 12 is fitted. The socket or tip 18 is preferably made from an elastomeric material or rubber in order to increase the frictional interaction thereof with a pedal against which the tip 18 is placed during use of the device. Also, the socket 18 is generally flat along its bottom face or surface 21. However, various shapes and configurations may be utilized to enhance gripping action of tip 18.

Figure 5:
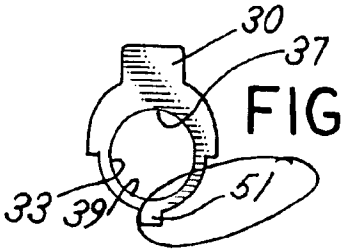
FIG. 5 is a plan view of the locking plate for the pedal depressor of FIG. 1.
Figure 4A:
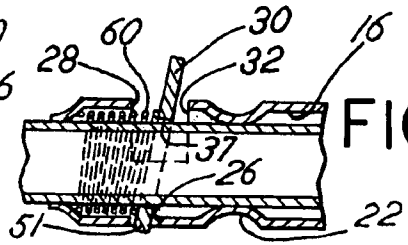
FIG. 4A is a cross sectional view taken along the line 4A—4A in FIG. 4.
Figure 3A:
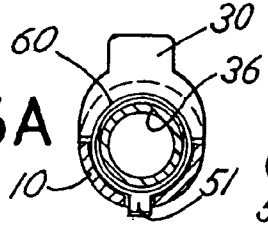
FIG. 3A is a cross sectional view taken along the line 3A—3A in FIG. 3.

The opposite open end 14 of the tube 10 includes a circumferential groove 22 approximately 1–1½ inches from the open end 14. A semi-circular slot 24 is provided intermediate the groove 22 and the open end 14. An opening or passage 26 is defined in the tube 10 aligned with the edge 28 of the slot 24 most closely adjacent to the open end 14. The slot 24 has a longitudinal or axial extent or dimension of approximately ⅜ of one inch. Thus, a manually actuated plate 30, depicted in plan view in FIG. 5, may be positioned in the slot 24 intermediate the front side edge 28 and a backside edge 32 generally transverse to an axis 31 of tube 10.

A second hollow cylindrical tube 36 has an outside diameter substantially equal to the necked down inside diameter or slightly less than the necked down inside diameter of groove 22 of the first tube 10. Thus, the second tube 36 is telescopically or adjustably slidable in the first tube 10. The interior end 40 of the second tube 36 is slightly flared to provide a friction fit of the tubes 36, 10 one within the other and to prevent the second tube 36 from exiting out of the first tube 10 past the groove 22.

The second tube 36 includes an open end 42 into which is fitted a yoke assembly 44. The yoke assembly 44 has a Y-shaped configuration. That is, the yoke assembly 44 includes a rod or cylindrical stub or stud 46 formed as the lower leg of a Y assembly configuration, and a transverse plate 48 with projecting wings 50 and 52. The stub 46 includes a circumferential groove 58 with an O-ring 61 therein. As a result, the stub 46 may be rotated within the tube 36; however, the O-ring 61 enables maintaining the yoke or plate assembly 44 oriented in a desired position. Note that the plate 48 is a flat plate which has been shaped to define a channel between the arms or wings 50 and 52. The width of the channel formed by the spaced arms 50 and 52 is on the order of 2–3 inches thereby insuring that the placement of a steering wheel in the formed channel or space between the arms 50 and 52 will be adequate to fit over the rim of a steering wheel, or against the edge of a vehicle seat, or against some other bracket.

Laterally extending side plates 54, 56 extend respectively in opposite directions from arms 50, 52. The side plates 54, 56 function to facilitate engagement of yoke 44 with a bracket, seat, etc.

Figure 3:
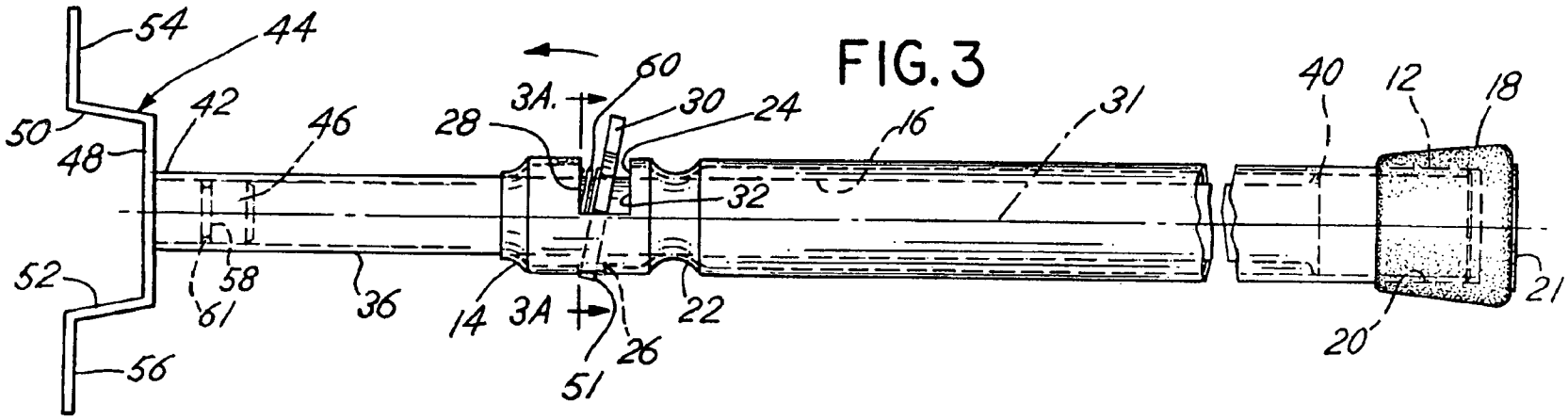
FIG. 3 is a side elevation view of the pedal depressor of FIG. 2.
Figure 4:
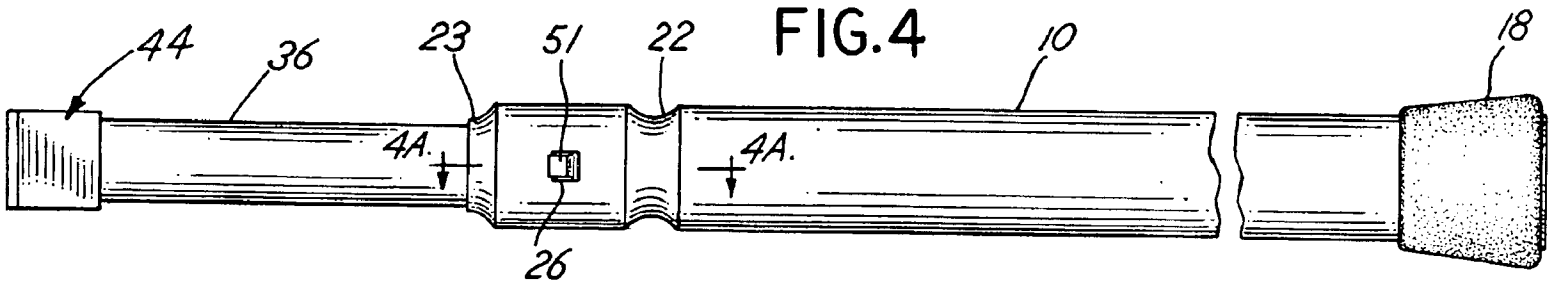
FIG. 4 is a bottom elevation view of the pedal depressor of FIG. 3.

The locking plate 30 includes a lower projecting tab 51 which fits into passage 26 and a central throughpassage 33 which is elongated and has a diameter or a profile in cross section which exceeds the cross sectional profile of the second tube 36. Thus, the second tube 36 may slidably pass through passage 33. However, when the locking plate 30 is canted or at an angle with respect to the second tube 36 and axis 31, the edges, and more particularly, the top edge 37 and bottom edge 39 will engage against the second tube 36 and bold the tube 36 in a fixed, non-telescoping opening 26 position. A biasing spring 60 fits between forward necked portion 23 of tube 10 against plate 30 and biases the plate 30 about the pivot point defined by the projecting tab or stud 51 fitted in passage or opening 26 to insure that the top edge 37 and/or bottom edge 39 of the plate 30 will engage the second tube 36 holding it in an adjustable, but locked position. Thus, the second tube 36, as shown in FIG. 3, will be retained in a fixed position due to the interaction of the plate 30 with the second tube 36. To release the locking plate 30 from tube 36, the plate 30 is engaged manually and moved in the counterclockwise direction as depicted in FIG. 3 by the arrow. This releases the engagement of the edge 37 of the plate 30 from the second tube 36 thereby enabling slidable movement and adjustment of the length of the device. Thereafter, the plate 30 is released from manual engagement and the biasing spring 60 will then again engage the second tube 36 causing the device to be locked in a fixed length position.

Preferably, spring 60 is a coil spring which fits over the tube 36. In this manner, when spring 60 is positioned between the necked down portion 23 of tube 10 and plate 30, spring 60 will be maintained in position to continually bias plate 30 toward the locking position.

In practice, as depicted in FIG. 1, the tip 18 is placed against a brake pedal, for example, and the manual adjustment plate 30 is manually engaged or pivoted so that the second tube 36 and yoke assembly 44 may be positioned by extension against a steering wheel, for example, or against the edge of a vehicle seat or some other fixed point within the vehicle. When engaging the steering wheel, for example, it may be necessary to adjust the orientation of the yoke assembly 44. This can be accomplished by rotating the yoke assembly about axis 31 within the second tube 36. The O-ring 61 provides adequate friction to maintain the orientation of the yoke 44. In any event, upon appropriate engagement of the yoke assembly 44 with a fixed point such as a steering wheel and appropriate extension and locking of the second tube 36 within the first tube 10, the device is in position to maintain a brake, or other pedal or other element, in a depressed or other desired position.

Various components of the device may be altered or changed without departing from the spirit and scope of the invention. For example, reconstruction of the yoke or plate assembly 44 may be varied. The side elements 54 and 56 may be omitted if desired. The size and shape of the tubes 10 and 36 may be varied. The shape and configuration of the tip 18 may be altered or varied. Numerous other alternatives are possible without altering the invention. The invention is therefore limited only by the following claims and equivalents thereof.

What is claimed is:

1. An adjustable vehicle pedal depressor tool comprising, in combination:

a first hollow, elongate tube having a pedal engaging end and an opposite open end;

a second slidable, elongate, telescoping tube slidably inserted into the first tube from the pedal engaging end through the open end of the first tube, said second tube including a first end with a bore opening, said second tube also including a second end having a flare;

a length adjustment and locking mechanism for adjusting and holding the second tube in a fixed telescopic position in the first tube with a reduced cross sectional profile adjacent the slot, said adjustment mechanism comprising a radial slot in the first tube, a single locking plate in the slot, said plate having an opening with the second tube extending through the opening, said opening having a profile exceeding the cross sectional profile of the second tube whereby the plate may be canted to engage and hold the second tube in a fixed position, a biasing member within the first tube engaging the first tube reduced cross sectional profile and the plate for biasing the plate toward the canted, locking position, said plate projecting from the slot for manual engagement to counter the biasing force of the biasing member and thereby release the second tube from a locked position; and a generally Y-shaped yoke member having a leg rotatably inserted into the bore opening of the second tube, said yoke member including first and second spaced arms extending from the leg.

2. The tool of claim 1 further including an elastomeric tip member on the pedal engaging end of the first tube.

3. The tool of claim 1 wherein the biasing member comprises a coil spring fitted around the second tube and within the first tube.

4. Apparatus for holding a vehicle pedal in a depressed position comprising, in combination:

a first cylindrical tube having a longitudinal axis, a pedal engaging end and an opposite end;

a second cylindrical tube having a first end slidably fitted into the pedal engaging end and through the opposite end of the first tube, said second tube including a second flared end; and a latch mechanism mounted at the opposite end of the first tube for engaging and latching the second tube in a fixed telescoped location in the first tube, said latching mechanism comprising a single plate pivotally mounted in a slot in the first tube, said first tube including a reduced cross sectional profile adjacent the slot, said plate pivotal between a first canted position relative to the axis thereby engaging the second tube and a second position disengaged from the second tube, said plate including a projecting edge for engaging the second tube when the plate is in the first canted position, said projecting edge being releasable from engaging the second tube by manual movement of the plate from the first canted engagement position to the second position, and a biasing element within the first tube engaging the plate and said reduced cross sectional profile for biasing the plate towards the first position; and a wheel engaging yoke affixed to the first end of the second tube, said yoke including first and second spaced arms projecting longitudinally from the second tube, said arms mounted on a stud rotatably mounted in the first end of the second tube whereby the arms may be rotated to be oriented for engagement with a fixture.

5. The apparatus of claim 4 further including a frictional element intermediate the stud and the second tube.

6. The apparatus of claim 5 wherein the frictional element is an elastomeric element.

7. The apparatus of claim 4 wherein the plate comprises a generally flat planar plate member with a central passage having a cross sectional profile greater than the cross sectional profile of the second tube, and further including a manual tab section for manual engagement to pivot the plate member.

8. The apparatus of claim 4 wherein the arms have a lateral dimension at least two times the diameter of the second tube.

9. The tool of claim 1 wherein the second tube comprises a hollow cylinder having an outside diameter less than the diameter of said flare and wherein said first tube comprises an inside diameter for receipt of the flared end of the second tube.

10. The tool of claim 1 including a friction member between the second tube and the leg.

11. The tool of claim 9 wherein the first tube includes a reduced cross section profile portion for limiting telescopic movement of the second tube within the first tube.

12. The tool of claim 1 wherein the first tube includes a reduced cross section profile portion for limiting telescopic movement of the second tube within the first tube.

13. An adjustable vehicle pedal depressor tool comprising, in combination:

a first hollow, elongate tube having an inside diameter, a pedal engaging end and an opposite open end;

a second slidable elongate telescoping tube slidably inserted into the first tube from the pedal engaging end through the open end of the first tube, said second tube including a first end with a bore opening, said second tube also including a second end having a flare with a dimension less than the inside diameter of the first tube;

a length adjustment and locking mechanism for adjusting and holding the second tube in a fixed telescopic position in the first tube, said adjustment mechanism comprising a radial slot in the first tube with a reduced cross sectional profile adjacent the slot, a single locking plate in the slot, said plate having an opening with the second tube extending through the opening, said opening having a profile exceeding the cross sectional profile of the second tube whereby the plate may be canted to engage and hold the second tube in a fixed position, a biasing member within the first tube positioned between the reduced cross sectional profile and the plate for biasing the plate toward the canted, locking position, said plate projecting from the slot for manual engagement to counter the biasing force of the biasing member and thereby release the second tube from a locked position; and a generally Y-shaped yoke member having a leg rotatably inserted into the bore opening of the second tube, said yoke member including first and second spaced arms extending from the leg.

14. Apparatus for holding a vehicle pedal in a depressed position comprising, in combination:

a first cylindrical tube having an inside diameter, longitudinal axis, a pedal engaging end and an opposite end;

a second cylindrical tube having a first end slidably fitted into the pedal engaging end and through the opposite end of the first tube, said second tube including a second flared end having a diameter less than the first tube inside diameter; and a latch mechanism mounted at the opposite end of the first tube for engaging and latching the second tube in a fixed telescoped location in the first tube, said latching mechanism comprising a single plate pivotally mounted in a slot in the first tube, said first tube including a reduced cross sectional profile adjacent the slot, said plate pivotal between a first canted position relative to the axis thereby engaging the second tube and a second position disengaged from the second tube, said plate including a projecting edge for engaging the second tube when the plate is in the first canted position, said projecting edge being releasable from engaging the second tube by manual movement of the plate from the first canted engagement position to the second position, and a biasing element within the first tube intermediate the plate and said reduced cross sectional profile for biasing the plate towards the first position; and a wheel engaging yoke affixed to the first end of the second tube, said yoke including first and second spaced arms projecting longitudinally from the second tube, said arms mounted on a stud rotatably mounted in the first end of the second tube whereby the arms may be rotated to be oriented for engagement with a fixture.

* * * * *